United States Patent [19]

Kameoka et al.

[11] 4,264,719

[45] Apr. 28, 1981

[54] METHOD FOR PREVENTING ADHESION OF SILVER HALIDE PHOTOGRAPHIC LIGHT-SENSITIVE MATERIAL

[75] Inventors: Kimitaka Kameoka; Ikutaro Horie; Hukuji Sakakibara; Takashi Naoi, all of Minami-ashigara; Masamichi Shimazaki, Fujinomiya, all of Japan

[73] Assignee: Fuji Photo Film Co., Ltd., Minami-ashigara, Japan

[21] Appl. No.: 45,557

[22] Filed: Jun. 4, 1979

Related U.S. Application Data

[63] Continuation of Ser. No. 887,916, Mar. 17, 1978, abandoned.

[30] Foreign Application Priority Data

Mar. 18, 1977 [JP] Japan ..... 52-30040

[51] Int. Cl.[3] ..... G03C 1/76; G03C 3/00

[52] U.S. Cl. ..... 430/537; 430/950; 430/961

[58] Field of Search ..... 96/67, 87 A, 50 PL, 96/114, 114.5, 84 R; 430/537, 950, 961

[56] References Cited

U.S. PATENT DOCUMENTS

| | | | |
|---|---|---|---|
| 3,411,907 | 11/1968 | Whitmore et al. | 96/67 |
| 3,591,379 | 7/1971 | Plakunov | 96/67 |
| 3,861,924 | 1/1975 | Mackey et al. | 96/114 |
| 4,021,245 | 5/1977 | Nagatomo et al. | 96/67 |

*Primary Examiner*—Richard L. Schilling

*Attorney, Agent, or Firm*—Sughrue, Rothwell, Mion, Zinn and Macpeak

[57] ABSTRACT

A method for preventing adhesion in a photographic light-sensitive material comprising a support having thereon at least one silver halide light-sensitive emulsion layer which comprises providing, as an outermost layer on at least one side thereof, a layer containing gelatin with the amount of gelatin coated being about 0.2 to about 0.8 g/m$^2$ and containing finely divided particles of a matting agent having an average particle size of about 0.1 to about 10 microns.

4 Claims, No Drawings

METHOD FOR PREVENTING ADHESION OF SILVER HALIDE PHOTOGRAPHIC LIGHT-SENSITIVE MATERIAL

This is a continuation, of application Ser. No. 887,916, filed Mar. 17, 1978 now abandoned.

BACKGROUND OF THE INVENTION

1. Field of the Invention

The present invention relates to a method for preventing adhesion of silver halide photographic light-sensitive materials, and, more particularly, to a method for preventing adhesion of photographic light-sensitive materials without impairing the transparency thereof after development processing.

2. Description of the Prior Art

In general, silver halide photographic light-sensitive materials have surface layers comprising a hydrophilic colloid such as gelatin as a binder, e.g., a light-sensitive emulsion surface-protective layer (hereafter referred to as a protective layer) and a backing layer (hereafter referred to as a back layer). Therefore, the surfaces of photographic materials tend to be adhesive or tacky under the conditions of high humidity, especially high temperature and high humidity, so that, when photographic materials come into contact with other materials, they adhere to the other materials easily. This phenomenon of adhesion occurs between photographic materials or between photographic materials and other materials with which photographic materials come into contact upon preparation and processing or during storage of photographic materials, and as a result, various disadvantages are encountered.

In order to obviate these problems, a variety of investigations have been made heretofore. One is the so-called matting method to thereby prevent adhesion which comprises incorporating finely divided powders of inorganic materials such as silicon dioxide, magnesium oxide, titanium dioxide, calcium carbonate, organic materials such as alkyl esters of acrylic acid or methacrylic acid such as polymethyl methacrylate, cellulose acetate propionate, etc., or the like (hereafter referred to as a matting agent) into surface layers to thereby increase surface roughness as described in U.S. Pat. Nos. 2,322,037 and 3,411,907. However, in order to obtain sufficient adhesion-preventing effect only by the incorporation of such a matting agent, a considerably large amount of a matting agent must be present in the surface layers. For this reason, agglomerated material is formed in a coating solution for the surface layers so that coating can be accomplished only with difficulty, and, more seriously, the transparency of the photographic light-sensitive materials after development processing is markedly impaired.

Other known methods comprise incorporating, for example, surface active agents, particularly flourine type surface active agents, or lubricants such as paraffin, into surface layers. However, a sufficient effect is not necessarily obtained.

SUMMARY OF THE INVENTION

Accordingly, a first object of the present invention is to provide a method for preventing adhesion of photographic light-sensitive materials having a surface layer containing gelatin.

A second object of the present invention is to provide a method for preventing adhesion of photographic light-sensitive materials without damaging physical properties such as transparency after processing or dimensional stability and photographic properties.

A third object of the present invention is to provide a photographic light-sensitive material in which undesired adhesion is prevented without damaging physical properties as well as photographic properties.

The objects of the present invention are achieved by a method for preventing adhesion in a photographic light-sensitive material comprising a support having thereon at least one silver halide light-sensitive emulsion layer, which comprises providing a layer in a coated amount of gelatin of about 0.2 to about 0.8 g/m$^2$ and containing a matting agent having an average particle size of about 0.1 to about 10 microns, as an outermost layer on at least one side thereof.

DETAILED DESCRIPTION OF THE INVENTION

In the present invention, the term "outermost layer" refers to a protective layer and a back layer, and also, where a layer is overcoated on these layers, this term refers to such an overcoat layer.

Conventionally, a protective layer is generally formed by coating gelatin in an amount of about 1.0 to about 1.5 g/m$^2$, and the back layer is generally formed by coating gelatin in an amount of about 3.0 to about 15 g/m$^2$. Where adhesion resistance (the property where adhesion does not occur) is improved by incorporating a matting agent in the outermost layer containing such a large amount of gelatin, good adhesion resistance is not obtained unless about 3 to 5% of a matting agent per unit weight (dry) of the gelatin forming the surface layer (above about 30 mg/m$^2$ as a coated amount) is employed, in general.

However, photographic light-sensitive materials having a surface layer containing such a large amount of gelatin as well as a matting agent have the disadvantage that the transparency thereof after development processing is markedly impaired.

The present invention is based upon the finding that by reducing the coated amount of gelatin in the outermost layer to about ½ or less than that present conventionally, transparency after development processing is markedly improved even if a matting agent used in combination therewith is incorporated in such a large amount that adhesion resistance to the same degree as in conventional photographic materials is obtained. According to the present invention, the coated amount of gelatin in the outermost layer is about 0.2 to about 0.8 g/m$^2$, preferably 0.3 to 0.7 g/m$^2$. For the thickness of the outermost layer generally used, this amount of about 0.2 to about 0.8 g/m$^2$ of gelatin corresponds to about 50 to 100% by weight of the entire binder present in the outermost layer. A preferred coated amount of all of the binders present in the outermost layer is about 0.3 to about 0.9 g/m$^2$.

In the present invention, the outermost layer is provided by coating a gelatin aqueous solution containing a matting agent.

Such a coating solution for the outermost layer can contain, in addition to a matting agent and gelatin, a viscosity increasing agent, colloidal silica, a surface active agent, a natural and synthetic high molecular weight material other than gelatin, a dye, a development accelerator and the like.

In particular, in the present invention, the gelatin containing layer as the outermost layer preferably is as thin as is possible (that is, the coated amount of gelatin is reduced). Therefore, the gelatin content in the coating solution for the outermost layer preferably is as small as is possible.

In general, it is conventional for coating solutions for gelatin-containing layers in photographic light-sensitive materials including a protective layer to contain about 4 to 10 wt%, on some occasions, about 20 wt%, based on the dry weight of gelatin.

In the present invention, as stated above, from the viewpoint that the coated amount of gelatin should be reduced to as low a level as possible, the gelatin content in the coating solution for the outermost layer preferably is less than about 4 wt%, particularly 2 to 3 wt%.

It is an extremely difficult technique to coat a coating solution containing such a small amount of gelatin, but coating can be easily accomplished by using a viscosity increasing agent to thereby increase the viscosity of the coating solution.

Viscosity increasing agents which can be employed for this purpose are preferably viscosity increasing agents which have a particularly marked viscosity increasing effect even in a dilute coating solution containing a small amount of gelatin and those where no problem upon coating (for example, formation of coagulated material, deterioration in surface quality, etc.) is encountered. To achieve a viscosity increasing effect, it is preferred for a viscosity increasing agent to be incorporated in an amount of less than about 5 wt% based on the gelatin into a 3 wt% gelation aqueous solution, and for the viscosity of the gelatin aqueous solution at 40° C. to be increased by 10 centipoise or more. A suitable viscosity range for the gelatin solution is about 10 to about 1,000 cps at 40° C.

Preferred examples of such viscosity increasing agents include homopolymers and copolymers of monomers selected from styrene, acrylic esters, acrylic acid, butylene, isobutylene, maleic acid, itaconic acid and derivatives thereof. Cellulose sulfate can also be used. Particularly preferred examples are polymers having a repeating unit represented by the formula below:

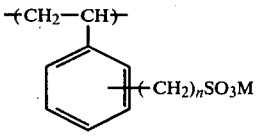

wherein M represents a hydrogen atom, an alkali metal cation, e.g., potassium ion, sodium ion, or an ammonium cation, and n represents 0, 1 or 2.

Viscosity increasing agents which are preferably employed in accordance with the present invention can be homopolymers or can be copolymers if about 20 mol% or more, preferably 50 mol% or more, of the repeating unit described above is present in the molecule thereof, but, of these, preferred examples are homopolymers wherein n is 0 or n is 1.

A suitable molecular weight range for these polymers is about 5,000 to about 1,000,000, and particularly, a molecular weight of 20,000 to 200,000 is preferred.

Specific examples of viscosity increasing agents which are preferably employed in accordance with the present invention are as follows:

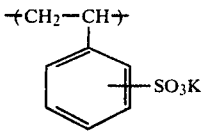

(1)

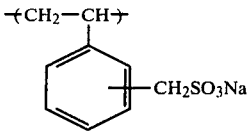

(2)

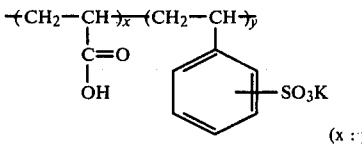

(3)

(x : y = 50 : 50)

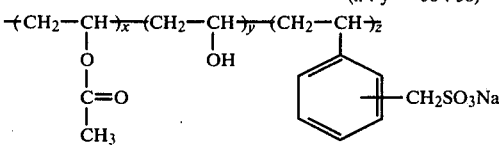

(4)

(x : y : z = 20 : 5 : 75)

(5) Cellulose sulfate.

In the above formulas, x, y and z represent the molar proportion.

It is preferred in the present invention for the viscosity increasing agent to be employed in an amount of about 0.1 to about 5 wt%, particularly 0.5 to 3 wt%, based on the dry weight of the gelatin.

A suitable viscosity for the coating solution can be about 10 to about 100 cps at 40° C., and particularly, a viscosity of 20 to 80 cps, is preferred.

In the present invention, the matting agent refers to particles of organic or inorganic compounds having an average particle size of about 0.1 to about 10 microns, preferably 0.3 to 5 microns.

Specific examples of suitable matting agents which are preferably employed include organic compounds such as water-dispersible vinyl polymers such as polymethyl methacrylate, cellulose acetate propionate, starch, etc., and inorganic compounds such as silver halide, strontium sulfate, barium sulfate, calcium carbonate, silicon dioxide, magnesium oxide, titanium oxide, etc.

In particular, when water-dispersible vinyl polymers such as homopolymers of substituted acrylic acid esters, e.g., methyl methacrylate, glycidyl acrylate, glycidyl methacrylate, etc., or copolymers of these acrylic acid esters or with other vinyl monomers copolymerizable therewith are employed, the danger of impairing the transparency of the light-sensitive materials after processing is reduced, which is preferred.

In the present invention, if the coated amount of a matting agent is reduced to as low as possible within the limit in which adhesion resistance is not damaged, transparency after processing is improved in proportion thereto, which is preferred. In order to reduce the amount of matting agent, it is preferred for colloidal silica to be employed in combination with a matting agent. By using colloidal silica in combination with a matting agent, the coated amount of the matting agent can be reduced and with the decrease in the coated amount of the matting agent, transparency after processing can further be improved.

Colloidal silica is an aqueous dispersion of silicic anhydride particles having an average particle size of about 5 to about 50 mμ, as described, for example, in U.S. Pat. Nos. 3,053,662 and 3,525,621, and E. Matijevic, *Surface & Colloid Science,* Vol. 6, pages 3 to 100 (1973), published by John Wiley & Sons, and are commercially available under the trade names of Ludox series made by Du Pont, Siton made by Monsanto Co., and Snowtex series made by Nissan Chemicals Industries Co., Ltd.

The amount of colloidal silica added is not limitative, but preferably about 5 to about 200% by weight based on the weight of gelatin, more preferably 10 to 120% by weight, is employed. By use of colloidal silica in combination with the matting agent, it becomes possible to reduce the coating amount of the matting agent to less than 2% by weight based on the dry weight of the gelatin, or about 5 to about 20 mg/m$^2$ as a coating amount, and as a result, transparency after processing can be markedly improved in proportion thereto.

Examples of gelatin which can be employed in the present invention include any of acid-processed gelatin, alkali-processed gelatin and enzyme-processed gelatin. The outermost layer according to the present invention can contain modified gelatin, gelatin derivatives, etc., which are ordinarily employed in the photographic art in addition to the gelatin.

The outermost layer in accordance with the present invention can contain conventional surface active agents for a variety of purposes such as a coating aid, improve antistatic properties, improvements in lubrication.

For instance, nonionic surface active agents such as saponin (steroid type), alkylene oxide derivatives (e.g., polyethylene glycol, polyethylene glycol/polypropylene glycol condensates, polyethylene glycol alkyl- or alkyl aryl ethers, polyethylene glycol esters, polyethylene glycol sorbitan esters, polyalkylene glycol alkyl amines or amides thereof, polyethylene oxide adducts of silicones), glycidol derivatives (e.g., alkenyl succinic acid polyglycerides, alkylphenol polyglycerides), fatty acid esters of polyvalent alcohols, alkyl esters of sucrose, urethanes or ethers thereof, etc.; anionic surface active agents containing acid groups such as a carboxyl group, a sulfo group, a phospho group, a sulfuric acid ester group, a phosphoric acid ester group, etc., such as triterpenoid type saponin, alkyl carboxylates, alkyl sulfonates, alkylbenzene sulfonates, alkylnaphthalene sulfonates, alkyl sulfates, alkyl phosphates, N-acyl-N-alkyltaurates, sulfosuccinates, sulfoalkyl polyoxyethylene alkylphenyl ethers, polyoxyethylene alkyl phosphates, etc.; amphoteric surface active agents such as amino acids, aminoalkyl sulfonates, aminoalkyl sulfates or phosphates, alkyl betaines, amine imides, amine oxides, etc.; cationic surface active agents such as alkylamine salts, aliphatic or aromatic quaternary ammonium salts, heterocyclic quaternary ammonium salts such as pyridinium, imidazolium, etc., aliphatic or hetero ring containing phosphonium or sulfonium salts, and the like, can be used.

Of these surface active agents, anionic surface active agents having less influence on photographic properties of the silver halide emulsion are particularly preferably employed.

In the case of light-sensitive materials for printing, inter alia, because of particularity in photographic properties, anionic surface active agents are most preferably employed.

The outermost layer of the present invention can contain, if desired, a gelatin hardening agent. Typical examples of such are chromium compounds (e.g., chromium alum, chromium acetate, etc.), aldehydes (e.g., formaldehyde, glyoxal, glutaraldehyde, etc.), N-methylol compounds (e.g., dimethylol urea, methylol dimethyl hydantoin, etc.), dioxane derivatives (e.g., 2,3-dihydroxydioxane, etc.), active vinyl compounds (e.g., 1,3,5-triacryloyl-hexahydro-s-triazine, bis(vinylsulfonyl)methyl ether, $(CH_2CH—SO_2CH_2CONHCH_2)_2$, $$CH_2CH—SO_2CH_2\underset{\underset{OH}{|}}{CH}—CH_2SO_2CH—CH_2,$$

etc.), active halogen compounds (e.g., 2,4-dichloro-6-hydroxy-s-triazine, etc.), mucohalic acids (e.g., mucochloric acid, mucophenoxychloric acid, etc.), isoxazoles, dialdehyde starch, 2-chloro-6-hydroxytriazinylated gelatin, etc., individually or in combination.

The present invention is applicable to any light-sensitive materials such as ordinary black-and-white light-sensitive materials, color light-sensitive materials, light-sensitive materials for printing, light-sensitive materials for X-rays, etc., but, in particular, is preferably applicable to light-sensitive materials containing a gelatin layer(s) having a polymer latex incorporated therein for the purpose of improving the dimensional stability or other purposes.

Polymer latexes which can be employed, particularly in light-sensitive materials for printing for the purpose of improving dimensional stability, are water-dispersible vinyl polymers such as acrylic acid esters, as described in U.S. Pat. Nos. 2,772,166, 3,325,286, 3,411,911, 3,311,912, 3,525,620, etc. Particularly preferred are homopolymers of alkyl acrylates such as methyl acrylate, ethyl acrylate, butyl acrylate, etc., or copolymers of these alkyl acrylates with other vinyl monomers copolymerizable therewith, having an average particle size of about 0.005 to about 1 micron, preferably 0.02 to 0.1 micron.

The incorporation of such a polymer latex into a gelatin-containing layer results in an improvement in the physical properties such as dimensional stability, layer softness, etc., on the one hand, but on the other hand, gives rise to the disadvantage that adhesion resistance is deteriorated.

Therefore, if the method of the present invention is applied to light-sensitive materials in which adhesion resistance is deteriorated by the addition of such a polymer latex, adhesion resistance can be improved without damaging the dimensional stability and at the same time, the transparency after processing it not impaired.

There is no particular limitation on the gelatin layers in which the polymer latex is incorporated, but it is preferred, of gelatin-containing layers of light-sensitive materials, for the polymer latex to be incorporated into a thicker layer, for instance, a silver halide emulsion layer and/or a back layer.

A suitable preferred amount of the polymer latex is about 10 to about 100%, more preferably 10 to 50%, based on the dry weight of gelatin of the gelatin layer.

The photographic light-sensitive materials to which the present invention can be applied comprise, in addition to a support having thereon a silver halide emulsion layer and an outermost layer, if desired, an intermediate layer, a filter layer, an antihalation layer, a subbing layer, etc.

As embodiments other than the outermost layer, any embodiments can be employed as are generally employed in this art.

For instance, the silver halide emulsion can be prepared in accordance with any of a general neutralization method, an acid method, a single jet method, a double jet method, etc. Any silver halide composition such as silver chloride, silver bromide, silver chlorobromide, silver iodobromide, silver chloroiodobromide, etc., can be employed.

In applying the present invention to light-sensitive materials for printing, silver chlorobromide or silver chloroiodobromide containing at least about 50 mol% of silver chloride (preferably more than 60 mol%) and containing 0 to 5 mol% of silver iodide is preferred for use as a silver halide composition.

Suitable chemical sensitizers for the silver halide emulsion, antifogging agents, stabilizing agents, gelatin hardening agents, hydrophilic colloid binders, antistatic agents, plasticizers, lubricants, coating aids, whitening agents, spectral sensitizers, dyes, color couplers, supports, coating methods, development processing methods, etc., which can be used are described in detail in Japanese Patent Application (OPI) No. 160034/75 (corresponding to British Pat. No. 1,489,080) (the term "OPI" as used herein refers to a "published unexamined Japanese patent application", hereinafter the same) and *Research Disclosure,* Vol. 92, pages 107 to 110 (December, 1971).

The present invention will be further explained in greater detail by reference to the examples hereinbelow, but the present invention is not to be construed as being limited thereto. Unless otherwise indicated herein, all percents, parts, ratios and the like are by weight.

EXAMPLE 1

A silver halide emulsion layer having the Composition (1) indicated below was coated onto one side of a polyethylene terephthalate film (thickness: 100 microns) having a subbing layer thereon in a dry thickness of 6.0 microns in a coated amount of 5.0 g/m$^2$ as silver.

Onto an opposite surface to the emulsion layer coated surface, a gelatin back layer having the Composition (2) indicated below was coated in a dry thickness of 5.5 microns.

Thereafter, a protective layer of the composition shown in Table 1 below was coated onto the silver halide emulsion layer to obtain Samples (1) through (4).

| Composition (1): Silver Halide Emulsion Layer Composition | |
|---|---|
| Silver Chloroiodobromide (Cl: 80 mol%, Br: 19.5 mol%, I: 0.5 mol%) | |
| Gelatin | 4 g/m$^2$ |
| Auric Chloride | 0.1 mg/m$^2$ |
| Polyoxyethylene Compound: | |

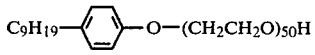

Sensitizing Dye:

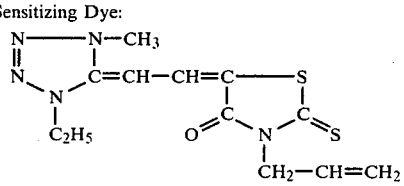

-continued

| Composition (1): Silver Halide Emulsion Layer Composition | |
|---|---|
| Antifogging Agent: | |
| 4-Hydroxy-6-methyl-1,3,3a,7-tetrazaindene | 30 mg/m$^2$ |
| Gelatin Hardening Agent: | |
| 2-Hydroxy-4,6-dichloro-1,3,5-triazine | 60 mg/m$^2$ |
| Surface Active Agent: | |
| Sodium p-dodecylbenzenesulfonate | 40 mg/m$^2$ |
| Viscosity Increasing Agent: | |
| Potassium polystyrene sulfonate (molecular weight 50,000) | 100 mg/m$^2$ |

| Composition (2): Back Layer Composition |
|---|
| Dye: 1:1:1 Mixture by weight of Dyes (I), (II) and (III) 0.3 g/m$^2$ |
| Dye (I): |

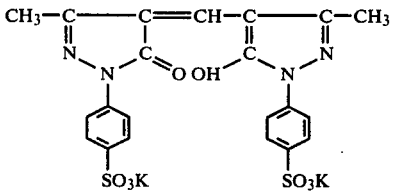

Dye (II):

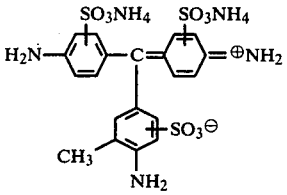

Dye (III):

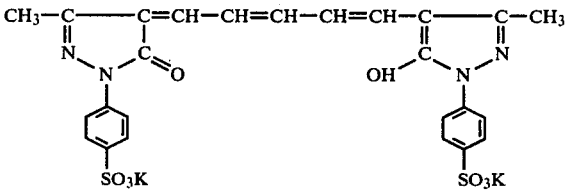

| |
|---|
| Gelatin (same as in Silver Halide Emulsion Layer Composition) |
| Surface Active Agent (same as in Silver Halide Emulsion Layer Composition) |
| Gelatin Hardening Agent (same as in Silver Halide Emulsion Layer Composition) |
| Viscosity Increasing Agent (same as in Silver Halide Emulsion Layer Composition) |

TABLE 1

| Composition for Protective Layer | Sample | | | |
|---|---|---|---|---|
| Composition | (1) (comparison) | (2) (comparison) | (3) (invention) | (4) (invention) |
| Gelatin (g/m$^2$) | 1.2 | 1.2 | 0.6 | 0.6 |
| Matting*1 Agent (g/m$^2$) | 0.05 | 0.01 | 0.05 | 0.005 |
| Viscosity*2 Increasing Agent (g/m$^2$) | — | — | 0.01 | 0.01 |
| Colloidal*3 Silica (g/m$^2$) | — | — | — | 0.36 |
| Surface*4 | | | | |

TABLE 1-continued

| Composition | Composition for Protective Layer Sample (1) (comparison) | (2) (comparison) | (3) (invention) | (4) (invention) |
|---|---|---|---|---|
| Active Agent (g/m²) | 0.03 | 0.03 | 0.03 | 0.03 |
| Gelatin*5 Hardening Agent (g/m²) | 0.01 | 0.01 | 0.01 | 0.01 |

*1 Polymethyl methacrylate (average particle size: 3.5 microns)
*2 Potassium polystyrene sulfonate (limiting viscosity: 2.0)
*3 Snowtex N, nade by Nissan Chemical Industries, Co., Ltd.
*4 Sodium p-dodecylbenzenesulfonate
*5 2,4-Dichloro-6-hydroxy-1,3,5-triazine sodium salt Using the thus-obtained Samples (1) through (4), adhesion was tested in accordance with the adhesion test method described in Example 1 of Japanese Patent Application (OPI) No. 6017/76 (corresponding to British Pat. No. 1,490,644).

Then, the unexposed Samples (1) through (4) were subjected to development processing at 27° C. for 1 minute and 45 seconds with Fuji Lith Developer LD-322 (trade name, made by Fuji Photo Film Co., Ltd.) using an FG-24 Pakoroll Automatic Developing Machine (trade name, made by Fuji Photo Film Co., Ltd.), fixed, washed with water and dried, and, thereafter, the transparency was measured.

The measurement of transparency was performed using a haze meter, ANA-147 Model, made by Tokyo Koden Co., Ltd.

The results obtained are shown in Table 2 below.

TABLE 2

| Property | Sample (1) (comparison) | (2) (comparison) | (3) (invention) | (4) (invention) |
|---|---|---|---|---|
| Adhesion*1 | A | C | A | A |
| Transparency*2 | 15 | 7 | 7 | 5 |

*1 Adhesion resistance becomes better in the order of A > B > C > D
*2 The values shown are haze values and thus the smaller the numerical value, the better the transparency is.

As can be seen from the results shown in Table 2 above, Comparison Sample (1) containing a large amount of gelatin coated as well a large amount of matting agent coated results in extremely poor transparency while adhesion resistance is good. Accordingly, a large amount of exposure is required upon exposure from light-sensitive materials for printing to other light-sensitive materials for printing or to a printing plate, and at the same time, dot quality is deteriorated, which is extremely disadvantageous. With Comparison Sample (2) in which the amount of the matting agent was reduced, the transparency was considerably improved but adhesion resistance was markedly deteriorated so that it cannot be used for practical purposes.

Samples (3) and (4) in accordance with the present invention are superior in adhesion resistance as well as transparency.

As can be seen from the above, this invention provides the ability to prevent undesired adhesion of photographic light-sensitive materials by reducing the amount of gelatin in the outermost layer to about 0.2 to about 0.8 g/m² from the coating amount conventionally used (e.g., about 1.0 to 1.5 g/m²) in the outermost layer which contains gelatin and a matting agent. More particularly, according to this invention, photographic materials with substantially the same effect of adhesion prevention and a greatly improved transparency for films processed therefrom as compared with those of conventional photographic materials are obtained using the reduced amount of gelatin as described above.

As shown specifically in the Examples given hereinbefore, reducing the transparency value from 15 to 7 while maintaining the effect of adhesion prevention at the same level is quite unexpected.

On the other hand, when the amount of the matting agent is increased to the extent that the improved transparency attained with the use of the reduced amount of gelatin is cancelled out, films having greatly improved effect in adhesion prevention for the same value of transparency can be produced.

In Example 1, a conventional film (Sample 1) containing gelatin in a coated amount of 1.2 g/m² exhibited a sufficient adhesion preventing effect since a large amount (0.05 g/m²) of a matting agent is present. This film sample, however, has very poor transparency after processing. In order to improve the transparency by reducing the amount of matting agent used to 0.01 g/m² (Sample 2) this results in a marked deterioration of adhesion preventing effect.

On the contrary, the film prepared according to the present invention containing 0.6 g/m² of gelatin (Sample 3) has markedly improved transparency so that a large amount (0.05 g/m²) of the matting agent can be used without deteriorating the adhesion preventing effect. With the use of colloidal silica (Sample 4) the adhesion preventing effect can be improved markedly and, thus, the amount of a matting agent used can be reduced accordingly. This results in the ability to improve the transparency further.

While the invention has been described in detail and with reference to specific embodiments thereof, it will be apparent to one skilled in the art that various changes and modifications can be made therein without departing from the spirit and scope thereof.

What is claimed is:

1. A photographic light-sensitive material comprising a support having thereon at least one silver halide emulsion layer and at least one outermost layer containing (a) gelatin with the amount of gelatin coated being about 0.3 to about 0.7 g/m² and (b) finely divided particles of polymethyl methacrylate as the sole matting agent having an average particle size of about 0.1 to about 10 microns and with the amount of polymethyl methacrylate particles coated being about 5 to about 20 mg/m².

2. The photographic light-sensitive material as claimed in claim 1, wherein said outermost layer is a protective layer, a back layer on the side of the support opposite to the at least on silver halide light-sensitive emulsion layer or an overcoat on said back layer.

3. The photographic light-sensitive material as claimed in claim 1, wherein said outermost layer additionally contains colloidal silica and/or a polymer having a repeating unit represented by the formula:

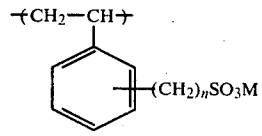

wherein n is 0 or 1 and M is an alkali metal ion, said polymer being present in an amount of about 0.1 to about 5% by weight based on the dry weight of the gelatin.

4. The photographic light-sensitive material as claimed in claim 1, wherein said outermost layer additionally contains colloidal silica.

* * * * *